US011318349B2

(12) United States Patent
Ahn

(10) Patent No.: US 11,318,349 B2
(45) Date of Patent: May 3, 2022

(54) HAND GRIPPER FOR BASEBALL PLAYER

(71) Applicant: Jong Hyun Ahn, Ansan-si (KR)

(72) Inventor: Jong Hyun Ahn, Ansan-si (KR)

( * ) Notice: Subject to any disclaimer, the term of this patent is extended or adjusted under 35 U.S.C. 154(b) by 0 days.

(21) Appl. No.: 17/378,291

(22) Filed: Jul. 16, 2021

(65) Prior Publication Data

US 2021/0339083 A1 Nov. 4, 2021

Related U.S. Application Data

(63) Continuation of application No. PCT/KR2019/017095, filed on Dec. 5, 2019.

(30) Foreign Application Priority Data

Sep. 26, 2019 (KR) ..... 10-2019-0118828

(51) Int. Cl.
*A63B 23/16* (2006.01)
*A63B 21/00* (2006.01)
(Continued)

(52) U.S. Cl.
CPC ..... *A63B 23/16* (2013.01); *A63B 21/026* (2013.01); *A63B 21/045* (2013.01); *A63B 21/4035* (2015.10); *A63B 2102/18* (2015.10)

(58) Field of Classification Search
CPC .... A63B 2069/0004; A63B 2069/0006; A63B 2069/0008; A63B 2069/0011;
(Continued)

(56) References Cited

U.S. PATENT DOCUMENTS 3,497,216 A * 2/1970 Feather ..... A63B 21/05 482/122
3,779,548 A * 12/1973 Sato ..... A63B 23/16 482/44
(Continued)

FOREIGN PATENT DOCUMENTS

JP 2003-038698 A 2/2003
JP 3122822 U 6/2006
(Continued)

OTHER PUBLICATIONS

English translation of KR 101701411 B1 (Year: 2017).*
(Continued)

*Primary Examiner* — Megan Anderson
*Assistant Examiner* — Thao N Do
(74) *Attorney, Agent, or Firm* — Studebaker & Brackett PC

(57) ABSTRACT

A hand gripper for a baseball player according to the present invention comprises: a body which is provided to be covered by the index finger, middle finger, and thumb of a user; and an elastic body which is fastened to the body to provide an elastic force. Here, the body has a partially cut-out ring shape, and includes an upper end, a lower end, and a gripping surface having a selected radius of curvature. The gripping surface is provided: to include a first boundary line which crosses the gripping surface in the lateral direction, and first protrusions repeatedly formed along the first boundary line; and such that the upper end and the lower end of the body can come into contact with each other as the body bends when the user applies force while gripping the body.

5 Claims, 6 Drawing Sheets

(51) Int. Cl.
*A63B 21/02* (2006.01)
*A63B 21/045* (2006.01)
*A63B 102/18* (2015.01)

(58) Field of Classification Search
CPC ..... A63B 2069/401; A63B 2069/402; A63B 2069/403; A63B 2069/404; A63B 2069/405; A63B 69/00; A63B 69/0002; A63B 69/0013; A63B 69/40; A63B 69/406; A63B 69/407; A63B 69/408; A63B 69/409; A63B 71/14; A63B 71/141; A63B 71/143; A63B 71/145; A63B 71/146; A63B 71/148; A63B 2102/18; A63B 21/00; A63B 21/0004; A63B 21/00058; A63B 21/00072; A63B 21/000181; A63B 21/00185; A63B 21/00189; A63B 21/00192; A63B 21/00196; A63B 21/012; A63B 21/0125; A63B 21/015; A63B 21/02; A63B 21/028; A63B 21/045; A63B 21/0455; A63B 21/05; A63B 21/055; A63B 21/026; A63B 21/4035; A63B 22/00; A63B 22/0002; A63B 22/0005; A63B 22/0007; A63B 22/0015; A63B 22/0017; A63B 22/0025; A63B 22/0048; A63B 22/18; A63B 23/00; A63B 23/035; A63B 23/03508; A63B 23/0355; A63B 23/12; A63B 23/1209; A63B 23/1218; A63B 23/1227; A63B 23/1236; A63B 23/1245; A63B 23/1254; A63B 23/1263; A63B 23/1272; A63B 23/1281; A63B 23/129; A63B 23/14; A63B 23/16
USPC ..... 482/49
See application file for complete search history.

(56) References Cited

U.S. PATENT DOCUMENTS 4,332,380 A * 6/1982 Cardin ..... A63B 21/00043 482/44
4,632,384 A * 12/1986 Bright ..... A63B 23/03508 482/49
4,726,580 A * 2/1988 Batiste ..... A63B 21/05 482/122
4,852,873 A * 8/1989 O'Donnell ..... A63B 21/00043 482/122
4,869,492 A * 9/1989 Joutras ..... A63B 21/4047 482/44
5,611,755 A * 3/1997 Blackmore ..... A63B 23/16 482/44
6,475,126 B1 * 11/2002 Hay, Jr. ..... A61H 7/001 482/121
8,852,033 B1 * 10/2014 Frost ..... A63B 71/143 473/206
2005/0153153 A1 * 7/2005 Saur ..... A63B 71/148 428/542.8
2007/0167288 A1 * 7/2007 Lin ..... A63B 23/16 482/49
2008/0103026 A1 * 5/2008 An ..... A63B 21/023 482/49
2010/0035710 A1 * 2/2010 Smith ..... A63B 43/06 473/570
2012/0023632 A1 * 2/2012 Provenzano ..... A41D 13/082 2/16
2012/0208677 A1 * 8/2012 Lally ..... A63B 23/032 482/11
2013/0139797 A1 * 6/2013 Oblack ..... A01K 15/025 473/607
2013/0260907 A1 * 10/2013 Kordecki ..... A63B 71/04 473/61
2017/0106261 A1 * 4/2017 DePaoli ..... A63B 60/14
2017/0144054 A1 * 5/2017 Landau ..... A41D 13/082
2017/0216670 A1 * 8/2017 Kuroda ..... A63B 24/0062
2017/0347727 A1 * 12/2017 Bailey ..... A63B 71/143
2017/0361184 A1 * 12/2017 Roy ..... A63B 69/3608
2018/0169458 A1 * 6/2018 Hao ..... A63B 21/00065
2018/0200582 A1 * 7/2018 Thurman ..... G09B 19/0038
2019/0223527 A1 * 7/2019 George ..... A41D 19/0037

FOREIGN PATENT DOCUMENTS

KR 10-0395890 B1 8/2003
KR 10-1701411 B1 2/2017
KR 101701411 B1 * 2/2017 ..... A63B 21/02

OTHER PUBLICATIONS

International Search Report issued in PCT/KR2019/017095; dated Jun. 23, 2020.
"Grant of Patent" Office Action issued in KR 10-2020-0112088; mailed by the Korean Intellectual Property Office dated Feb. 4, 2021.

* cited by examiner

HAND GRIPPER FOR BASEBALL PLAYER

CROSS-REFERENCE TO RELATED APPLICATION

This application is a continuation of International Patent Application No. PCT/KR2019/017095, filed on Dec. 5, 2019, which claims priority to and the benefit of Korean Patent Application No. 10-2019-0118828, filed on Sep. 26, 2019, the disclosure of which is incorporated herein by reference in its entirety.

BACKGROUND

1. Field of the Invention

The present invention relates to a hand gripper for a baseball player, and more particularly, to a hand gripper for a baseball player provided to be gripped using an index finger, a middle finger, and a big finger.

2. Discussion of Related Art

A baseball game is one of the sports loved by many people. In recent years, more and more people enjoy actually playing the baseball game rather than simply watching the baseball game.

Muscles used in the baseball game are different from those used in everyday life. In particular, when throwing a baseball, thrust is transmitted to the baseball using a lower body, shoulders, arms, and wrists. A trajectory of the baseball until the baseball leaves a hand forms a circular motion, and at a moment when the baseball leaves the hand, the baseball is thrown in a tangential direction of the circular motion. In this case, when fingers do not have enough force to support the baseball, the baseball leaves the hand at an undesired time point. Thus, in order to properly transmit the force to the baseball even while throwing the baseball in a correct direction, it is necessary to train the force of the fingers for supporting the baseball.

In the related art, the force of the finger for supporting the baseball has been trained through a hand gripper. Korean Patent Registration No. 10-0395890 discloses such a hand gripper.

However, in the above Korean registered patent, the hand gripper is used with four fingers and a palm excluding a big finger, whereas the baseball is gripped using the big finger, a middle finger, and an index finger. Thus, the hand gripper according to the related art trains only muscles necessary for gripping the hand gripper but does not intensively train muscles actually necessary for gripping the baseball.

SUMMARY OF THE INVENTION

The present invention is directed to providing a hand gripper for a baseball player which may be gripped in the same manner as an actual baseball gripping method and thus intensively train muscles required to grip a baseball.

One aspect of the present invention provides a hand gripper for a baseball player including: a body provided to be covered and gripped by an index finger, a middle finger, and a big finger of a user; and an elastic body fastened to the body to provide an elastic force. The body, which has a partially cut-out ring shape, may include an upper end and a lower end and include a gripping surface having a predetermined radius of curvature, the gripping surface may have a first boundary line transversely crossing the gripping surface, and a first protrusion repeatedly formed along the first boundary line, and when the user applies a force while gripping the body, the body may be bent, and thus the upper end and the lower end of the body may come into contact with each other.

The radius of the curvature of the gripping surface may be in a range of 3.5 to 4.5 cm.

In the first boundary line, a shortest distance from a virtual reference line equally and vertically dividing the gripping surface to one end of the first boundary line along the gripping surface and a shortest distance from the virtual reference line to the other end of the first boundary line may be different from each other.

The gripping surface may include a second boundary line transversely crossing the gripping surface and a second protrusion repeatedly formed along the second boundary line, wherein the second boundary line and the second protrusion may be provided at positions rotated by 180° from the first boundary line and the first protrusion with respect to a first horizontal line passing through a center of the curvature of the gripping surface in a left-right direction.

The second boundary line and the second protrusion may be provided at positions rotated by 180° from the first boundary line and the first protrusion with respect to a second horizontal line passing through the center of the curvature of the gripping surface in a front-rear direction.

The second boundary line and the second protrusion may be located to be opposite to the first boundary line and the first protrusion with respect to a virtual horizontal surface equally and vertically dividing the gripping surface.

The body may include a first folding groove that is provided in a horizontal direction in the body and is repeatedly formed along an inner surface of the body.

The body may include an inclined surface inclined inward from the body on each of two sides of the body in order to reduce a load generated on the two sides of the body when the body is bent in a direction in which the upper end and the lower end of the body come into contact with each other.

The body may include a second folding groove repeatedly provided in a lengthwise direction of the body on each of two sides of the body in order to reduce a load generated on the two sides of the body when the body is bent in a direction in which the upper end and the lower end of the body come into contact with each other.

The hand gripper may include a first deformation prevention clip inserted into the first folding groove in order to prevent deformation of the body due to repeated use.

The hand gripper may include a second deformation prevention clip inserted into the second folding groove in order to prevent deformation of the body due to repeated use.

DETAILED DESCRIPTION OF EXEMPLARY EMBODIMENTS

Hereinafter, exemplary embodiments of a hand gripper for a baseball player according to the present invention will be described in detail with reference to the accompanying drawings. However, it is apparent that the hand gripper for a baseball player according to the present invention is not limited to the embodiments described below and may include all modifications, equivalents, and substitutes included in the spirit and the technical scope of the present invention.

Figure 1:
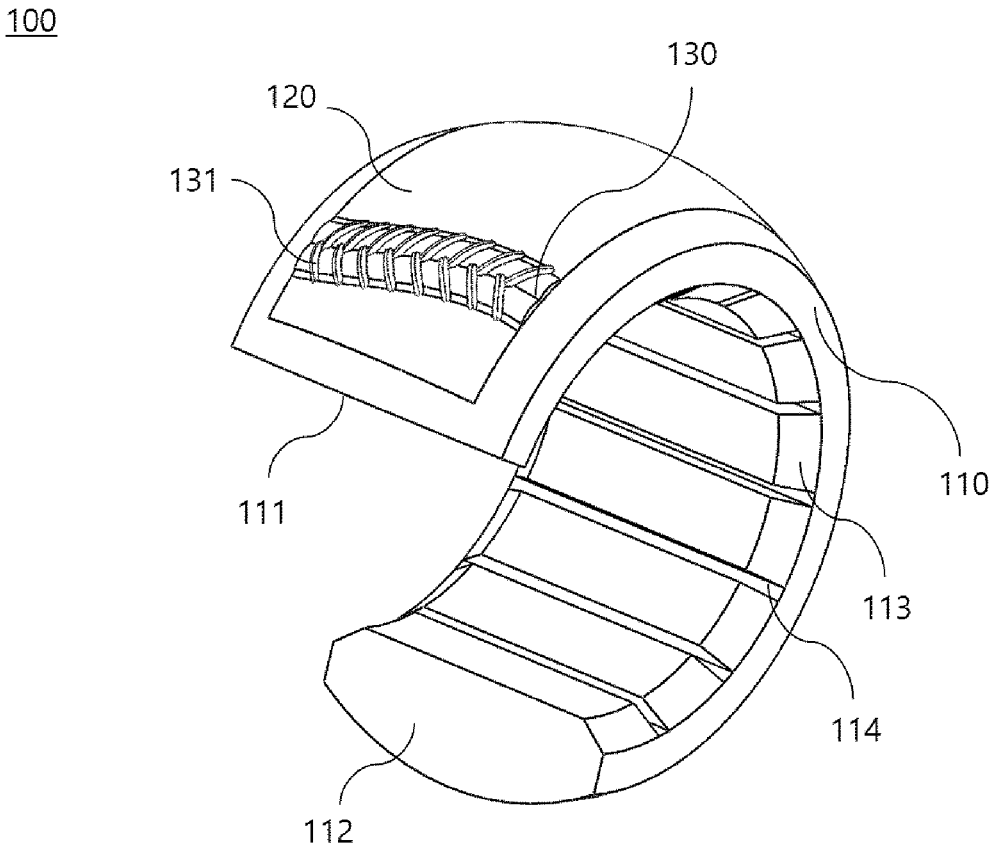
FIG. 1 is a perspective view of a hand gripper for a baseball player according to the present invention.

As illustrated in FIG. 1, a hand gripper 100 for a baseball player according to the present invention includes a body 110 and an elastic body (not illustrated).

The elastic body may be a plate spring made of a spring steel material and is fastened to the body 110 to provide elasticity to the hand gripper 100.

The body 110, which has a partially cut-out ring shape, includes an upper end 111 and a lower end 112 and includes a gripping surface 120 having a predetermined radius a of curvature.

The reason why the body 110 has the cut-out ring shape is that a user clearly recognizes start and end of movement when using the hand gripper 100, and when the upper end 111 comes into contact with the lower end 112, one movement is completed.

Figure 2:
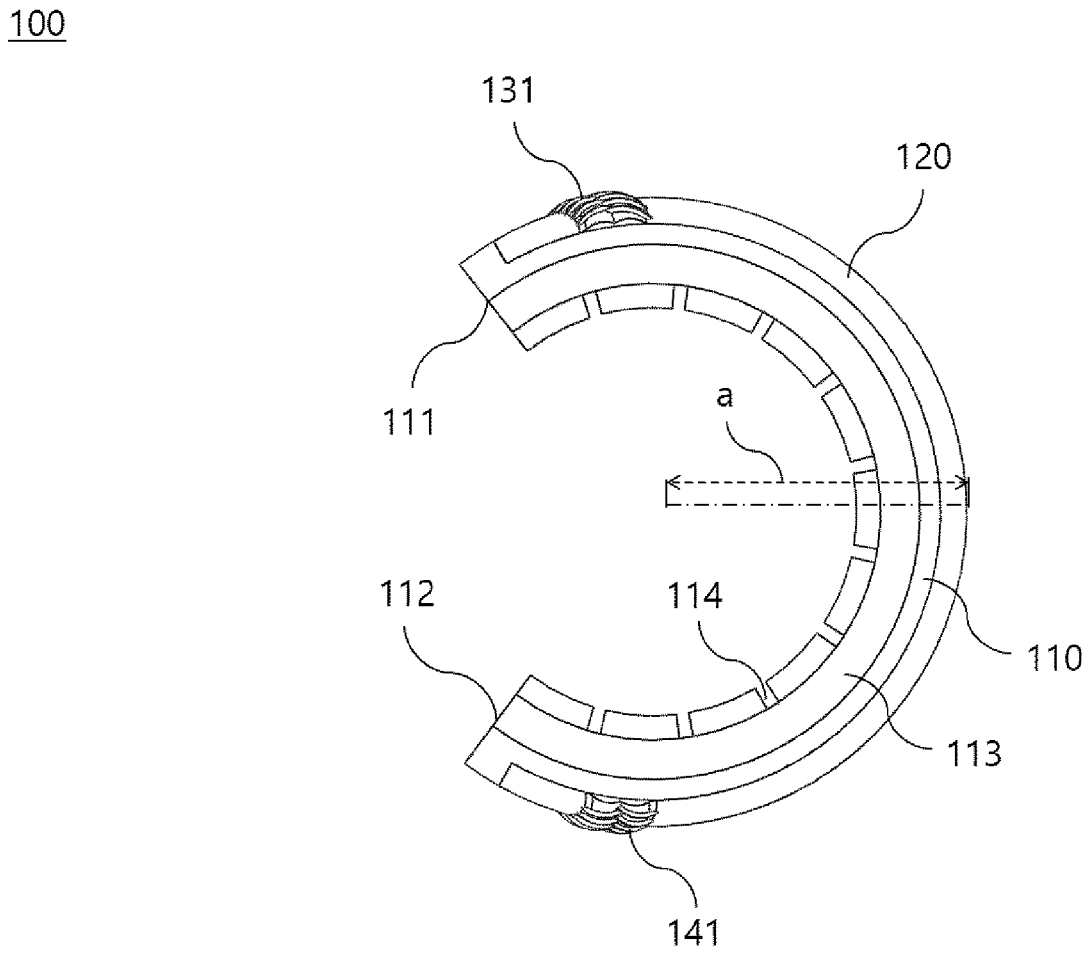
FIG. 2 is a view illustrating the hand gripper for a baseball player when viewed from a side surface according to the present invention.

Meanwhile, as illustrated in FIG. 2, the reason why the gripping surface 120 of the body 110 has the predetermined radius a of curvature is that a part actually gripped by the user has an identical or similar shape to the baseball. Considering that the radius of curvature of the baseball is in a range of appropriately 3.6 to 3.7 cm, it is preferable that the radius a of curvature of the gripping surface 120 is in a range of 3.5 to 4.5 cm.

The gripping surface 120 has a first boundary line 130 transversely crossing the gripping surface 120 and a first protrusion 131 repeatedly formed along the first boundary line 130.

The most basic factor among factors affecting a rotation direction of the baseball when gripping and then throwing the baseball is a position of gripping stitches of the baseball. That is, the rotation direction of the baseball changes depending on a position at which the user grips the stitches with the index finger and the middle finger, and in the most basic fast ball, the baseball is held across the stitches with the index finger and the middle finger placed side by side.

Thus, due to the first boundary line 130 and the first protrusion 131 described above, the user may receive the feeling of the stitches of the baseball from the index finger and the middle finger and may grip the hand gripper 100 in a position of throwing the fast ball.

Figure 3:
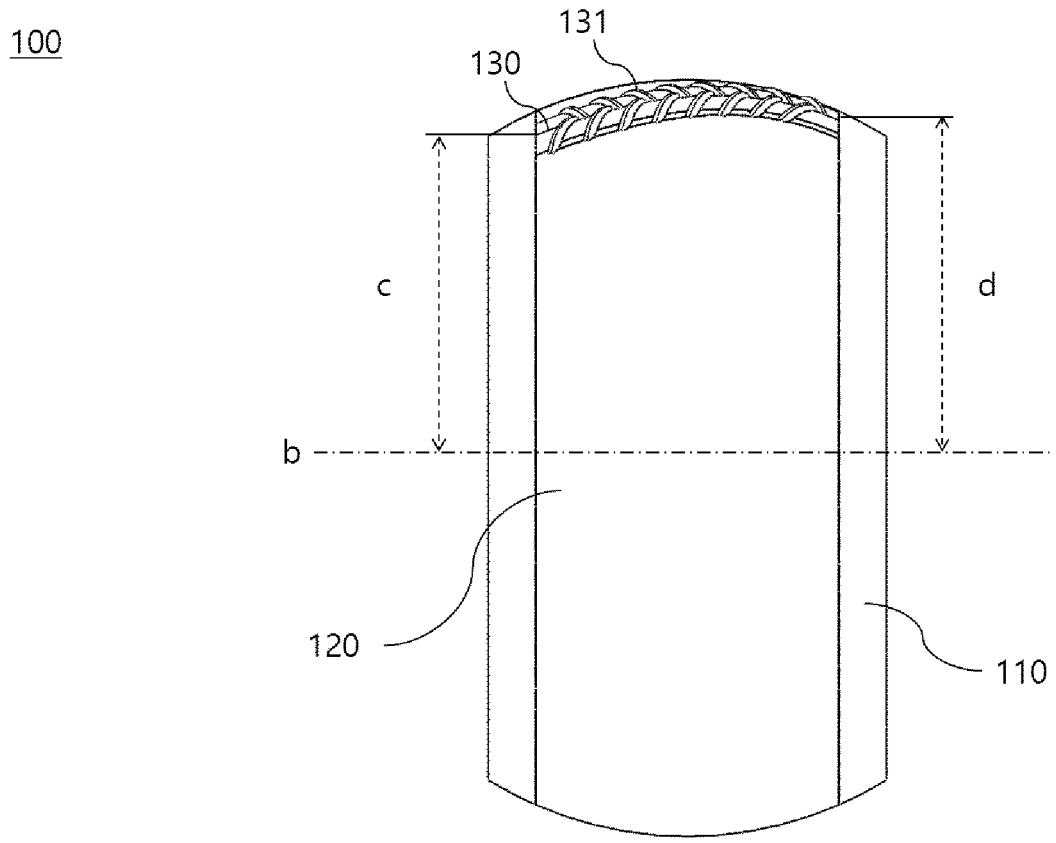
FIG. 3 is a view illustrating the hand gripper for a baseball player when viewed from a front surface according to the present invention.

In this case, since the lengths of the index finger and the middle finger are generally different, as illustrated in FIG. 3, it is preferable that the shortest distance c (hereinafter, a left one end shortest distance) from a virtual line b equally and vertically dividing the gripping surface 120 to one end of the first boundary line 130 along the gripping surface 120 and the shortest distance d (hereinafter, a right one end shortest distance) from the virtual line b to the other end of the first boundary line 130 are different from each other.

In more detail, in the case of a right hand, since the index finger is located on the left side of the middle finger, when the left one end shortest distance c of the first boundary line 130 is provided to be shorter than the right one end shortest distance d, the user may grip the hand gripper 100 for a baseball player at a correct position.

In contrast, in the case of a left hand, since the index finger is located on the right side of the middle finger, when the left one end shortest distance c of the first boundary line 130 is provided to be longer than the right one end shortest distance d, the user may grip the hand gripper 100 for a baseball player at a correct position.

Meanwhile, as described above, the user may receive the feeling of gripping the baseball from the index finger and the middle finger through the first boundary line 130 and the first protrusion 131. However, when actually gripping the baseball, the user may feel the stitches of the baseball even in a big finger serving to support the baseball in addition to the index finger and the middle finger.

Thus, the gripping surface 120 includes a second boundary line 140 and a second protrusion 141, and the second boundary line 140 and the second protrusion 141 may be provided at positions rotated by 180° from the first boundary line 130 and the first protrusion 131 with respect to a first horizontal line passing through the center of curvature of the gripping surface 120 in a left-right direction.

The above-described positions of the second boundary line 140 and the second protrusion 141 and the above-described positions of the first boundary line 130 and the first protrusion 131 are the same as the positions of the stitches in contact with the index finger, the middle finger, and the big finger when actually gripping the baseball.

Unlike this, the second boundary line 140 and the second protrusion 141 are provided at positions rotated by 180° from the first boundary line 130 and the first protrusion 131 with respect to a second horizontal line passing through the center of curvature of the gripping surface 120 in a front-rear direction so that the right hand and the left hand may use the hand gripper 100.

Figure 4:
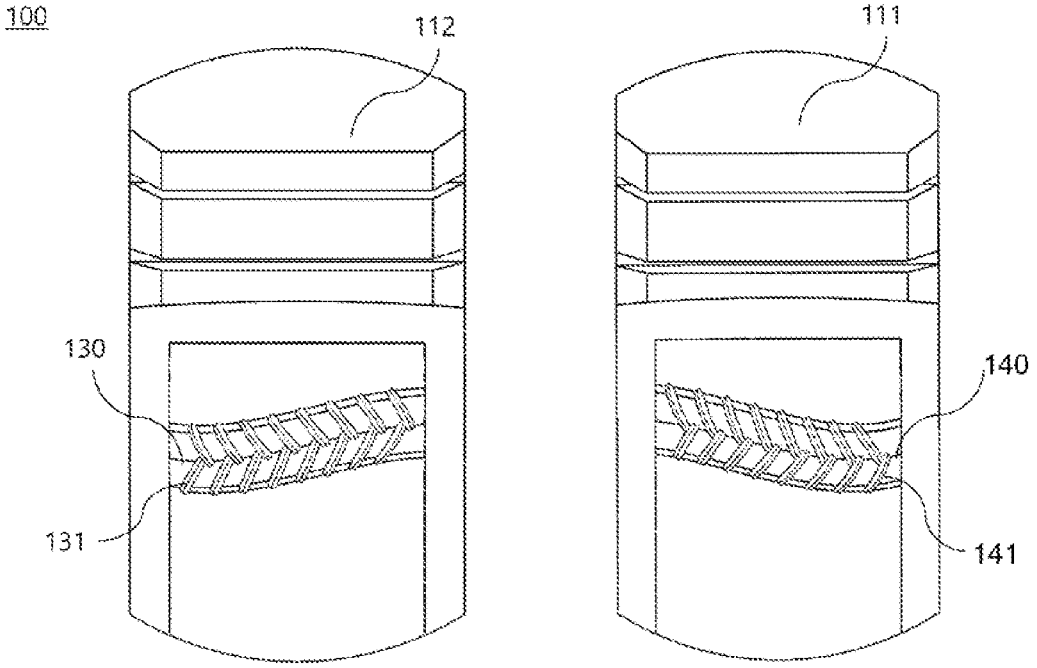
FIG. 4 is a view illustrating the hand gripper for a baseball player according to one embodiment of the present invention.

That is, as illustrated in FIG. 4, when the first boundary line 130 and the first protrusion 131 are formed with respect to the right hand, and when the second boundary line 140 and the second protrusion 141 are provided at positions rotated by 180° from the first boundary line 130 and the first protrusion 131 with respect to the second horizontal line passing through the center of curvature of the gripping surface 120 in the front-rear direction, the hand gripper 100 may be gripped at the correct position through the second boundary line 140 and the second protrusion 141 even with the left hand.

Thus, using the one hand gripper 100 for a baseball player, both the right hand and the left hand may perform gripping at the correct position.

Figure 5:
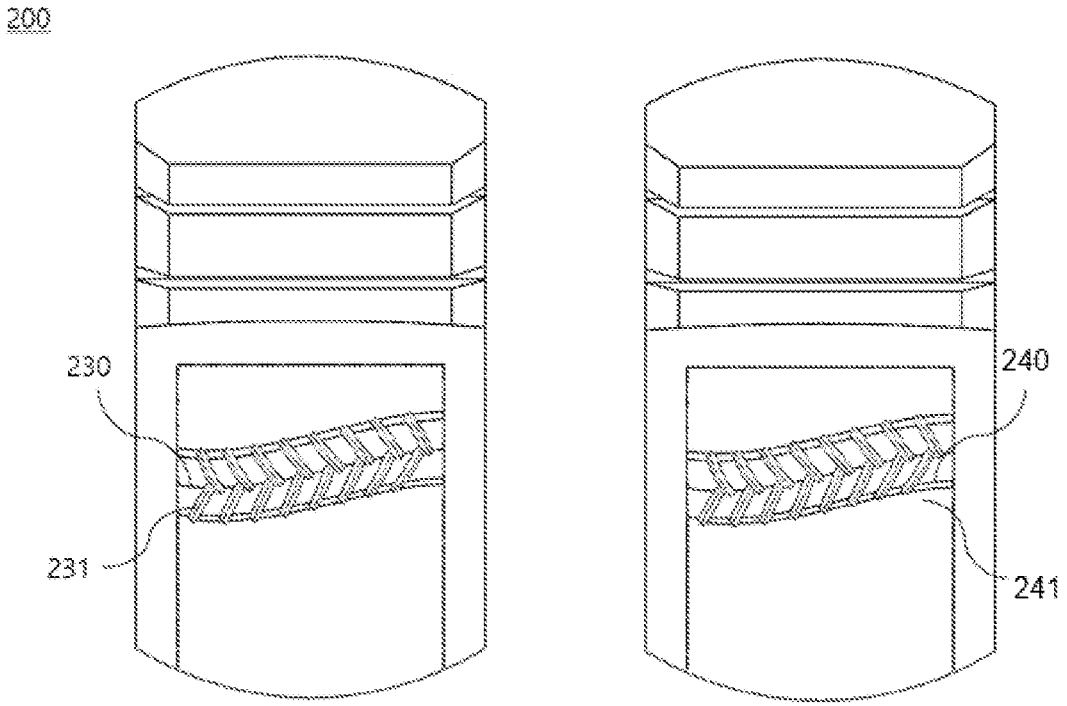
FIG. 5 is a view illustrating the hand gripper for a baseball player according to another embodiment according to the present invention.

Unlike this, as illustrated in FIG. 5, the second boundary line 240 and the second protrusion 241 may be provided in positions opposite to the first boundary line 230 and the first protrusion 231 with respect to a virtual horizontal surface equally and vertically dividing a gripping surface so that the user may use the hand gripper 200 regardless of a rotational state of the hand gripper 200 on the basis of either the right hand or the left hand.

That is, the user may grip the hand gripper 200 using the first boundary line 230 and the first protrusion 231 at the correct position with respect to the right hand and may also grip the hand gripper 200 even using the second boundary line 240 and the second protrusion 241 at the correct position.

In the above, the characteristics of the hand gripper 100 for a baseball player based on the user according to the present invention have been described. However, hereinafter, characteristics related to the durability of the hand gripper 100 for a baseball player according to the present invention will be described.

In the hand gripper 100 for a baseball player according to the present invention, since the body 110 itself that is a gripped part is repeatedly folded and unfolded unlike the existing hand grippers, a force that deforms the outer shape of the body 110 acts during use.

When the upper end 111 and the lower end 112 of the body 110 move in a direction in which the upper end 111 and the lower end 112 come into contact with each other, an inner surface of the body 110 is compressed, which eventually acts as a factor of reducing the durability of the body 110. In this way, when a force of deforming the body 110 acts repeatedly, the durability of the body 110 is degraded.

Thus, as illustrated in FIGS. 1 and 2, the hand gripper 100 for a baseball player according to the present invention may include a first folding groove 114 provided in a horizontal direction of the body 110 and repeatedly formed along the inner surface of the body 110, and accordingly, the durability of the body 110 can be increased.

Meanwhile, when the upper end 111 and the lower end 112 of the body 110 move in a direction in which the upper end 111 and the lower end 112 come into contact with each other, a side surface of the body 110 is compressed in a slightly different manner from the inner surface of the body 110.

In more detail, when the upper end 111 and the lower end 112 of the body 110 move in a direction in which the upper end 111 and the lower end 112 come into contact with each other, a portion of the side surface of the body 110 that is close to the inner side is compressed, and a portion of the side surface that is close to the outside is tensioned. In this case, the difference between the compression and the tension increases as the height of the side surface increases.

Thus, the hand gripper 100 for a baseball player according to another embodiment of the present invention has an inclined surface 113 inclined inward from the body 110 on each of two sides of the body 110.

The inclined surface 113 may provide an effect of lowering the height of the side surface, and as a result, the difference between the compression and the tension acting on the side surface of the body 110 may be reduced to further increase the durability of the body 110.

Further, in order to further reduce the deformation occurring on the side surface, second folding grooves 312 repeatedly provided on two sides of the body 110 in the lengthwise direction of the body 110 may be included.

The second folding grooves 312 may distribute a force acting on the side surface of the body 110 in the same manner in which the first folding groove 114 distributes the force acting on the inner surface of the body 110.

Figure 6:
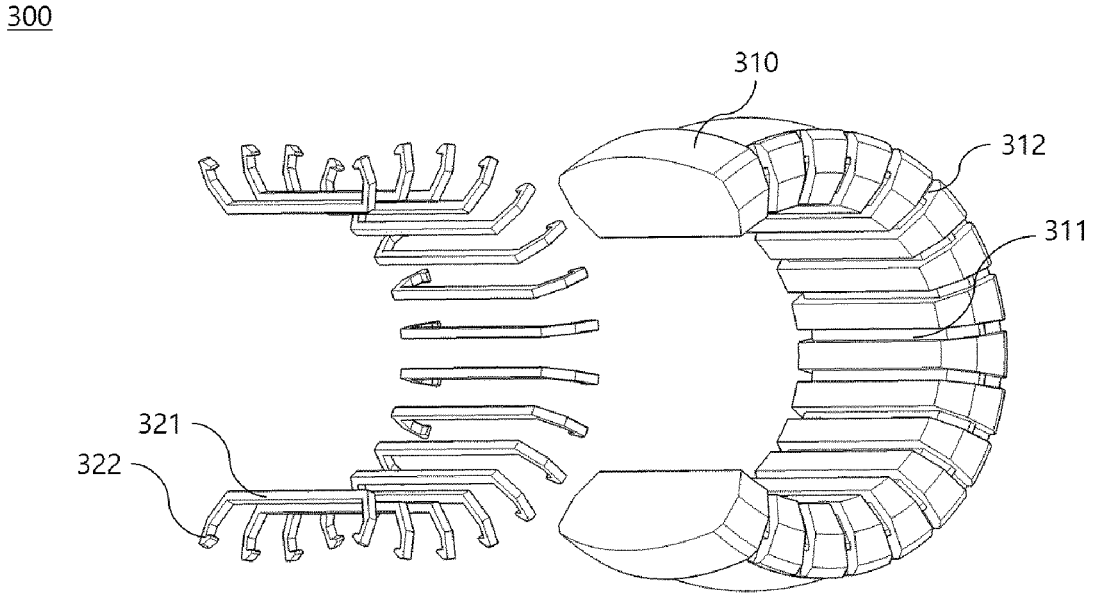
FIG. 6 is a view illustrating the hand gripper for a baseball player according to still another embodiment surface according to the present invention.

In this case, as illustrated in FIG. 6, it is preferable that the first folding groove 311 and the second folding grooves 312 are connected to each other.

Meanwhile, a phenomenon may occur in which a restoring force is lost while the body 310 is repeatedly folded and unfolded.

Thus, in order to prevent deformation of the body 310 due to repeated use, the hand gripper 300 for a baseball player according to the present invention includes a first deformation prevention clip 321 inserted into the first folding groove 311.

In this case, it is preferable that the first deformation prevention clip 321 is made of a material having a higher rigidity than that of the body 310.

When the rigidity of the first deformation prevention clip 321 is greater than the rigidity of the body 310, and when the body 310 is deformed from the existing shape, a repulsive force is generated at a part at which the first folding groove 311 and the first deformation prevention clip 321 are in contact with each other.

Thus, when the body 310 is unfolded, the first folding groove 311 of the body 310 is widened as much as a space occupied by the first deformation prevention clip 321, and thus the deformation of the body 310 due to repeated use can be prevented.

Similarly, a second deformation prevention clip 322 for preventing the deformation of the body 310 due to repeated use may also be inserted into the second folding groove 312 provided on the side surface of the body 310.

In this case, as illustrated in FIG. 6, it is preferable that when the first folding groove 311 and the second folding groove 312 are connected to each other, the first deformation prevention clip 321 and the second deformation prevention clip 322 are also connected to each other.

According to the present invention, a user may grip a hand gripper in the same position as gripping a baseball and, particularly, may feel, from a first boundary line and a first protrusion, a tactile sensation similar to that of stitches felt in an index finger and a middle finger when gripping the baseball.

Further, the hand gripper suitable for a hand of a person may be predetermined and used depending on the size of the hand of the person without greatly departing from the size of a baseball.

Further, since the lengths of the index finger and the middle finger of the user are generally different from each other, the user can grip the hand gripper in a correct position due to the first boundary line and the first protrusion formed to match the lengths.

Further, a feeling of the stitches in a big finger in addition to a feeling of the stitches in contact with the index finger and the middle finger can also be made from a second boundary line and a second protrusion, and thus the user can feel like actually gripping a baseball.

On the other hand, the second boundary line and the second protrusion can be formed at positions that allow both a right hand and a left hand to use the one hand gripper.

On the other hand, the second boundary line and the second protrusion can be formed at positions that enable the user to equally grip the hand gripper regardless of a rotation state of the hand gripper.

Meanwhile, in consideration of the characteristics of the hand gripper for a baseball player according to the present invention in which a body is repeatedly folded and unfolded, a first folding groove can be provided in the body, and thus a load generated on the inner surface of the body can be reduced, thereby improving the durability of the body.

Further, due to an inclined surface provided on a side surface of the hand gripper, when the body is folded and unfolded, a load generated on the side surface of the hand gripper is reduced, thereby improving the durability of the hand gripper.

Further, due to a second folding groove provided on the side surface, a load generated in the side surface of the hand gripper can be further reduced, thereby improving the durability of the hand gripper.

Further, the occurrence of a deformation state in which the body is not restored to an original state thereof due to repeated use can be prevented through a first deformation prevention clip and a second deformation prevention clip.

As described above, it is apparent that the present invention has been described with reference to the limited embodiments, but is not limited thereto, and may include all changes, equivalents, or substitutes included in the spirit and technical scope of the present invention.

What is claimed is:

1. A hand gripper for a baseball player, comprising:

a body configured to be covered and gripped by an index finger, a middle finger, and a big finger of a user; and an elastic body fastened to the body to provide an elastic force, wherein the body includes:

a gripping surface, which has a partially cut-out ring shape, including an upper end and a lower end, and having a predetermined radius of curvature, wherein, in response to a force applied by the user, the body is configured to be bent, and an upper end and a lower end of the body are configured to contact with each other;

a plurality of first folding grooves that are provided in a horizontal direction in the body and are repeatedly formed along an inner surface of the body; and an inclined surface inclined inward from the body on each of two sides of the inner surface of the body, wherein the plurality of first folding grooves are positioned to penetrate the inclined surface in the horizontal direction of the body, and wherein the plurality of first folding grooves and the inclined surface are configured to reduce a load generated on the two sides of the body when the body is bent in a direction in which the upper end and the lower end of the body come into contact with each other.

2. The hand gripper of claim 1, wherein the gripping surface has a first boundary line transversely crossing the gripping surface; and a first protrusion repeatedly formed along the first boundary line.

3. The hand gripper of claim 1, further comprising a second folding groove repeatedly provided in a lengthwise direction of the body on each of the two sides of the body in order to reduce the load generated on the two sides of the body when the body is bent in the direction in which the upper end and the lower end of the body come into contact with each other.

4. The hand gripper of claim 1, further comprising a deformation prevention clip inserted into the first folding groove in order to prevent deformation of the body due to repeated use.

5. The hand gripper of claim 3, further comprising a deformation prevention clip inserted into the second folding groove in order to prevent deformation of the body due to repeated use.

* * * * *